US009326908B2

(12) United States Patent
Scott

(10) Patent No.: US 9,326,908 B2
(45) Date of Patent: May 3, 2016

(54) BODY STRETCHING ASSEMBLY

(71) Applicant: William Scott, Porterville, CA (US)

(72) Inventor: William Scott, Porterville, CA (US)

( * ) Notice: Subject to any disclaimer, the term of this patent is extended or adjusted under 35 U.S.C. 154(b) by 0 days.

(21) Appl. No.: 14/161,257

(22) Filed: Jan. 22, 2014

(65) Prior Publication Data

US 2014/0315695 A1 Oct. 23, 2014

Related U.S. Application Data

(60) Provisional application No. 61/813,074, filed on Apr. 17, 2013.

(51) Int. Cl.

| | |
|---|---|
| ***A61H 1/02*** | (2006.01) |
| ***A63B 21/00*** | (2006.01) |
| ***A63B 21/16*** | (2006.01) |
| ***A63B 21/068*** | (2006.01) |

(52) U.S. Cl.

CPC ..... *A61H 1/02* (2013.01); *A61H 1/0237* (2013.01); *A61H 1/0274* (2013.01); *A63B 21/00178* (2013.01); *A63B 21/00185* (2013.01); *A63B 21/068* (2013.01); *A63B 21/154* (2013.01); *A63B 21/1663* (2013.01); *A63B 21/4003* (2015.10); *A63B 21/4019* (2015.10); *A63B 21/4035* (2015.10); *A61H 1/0296* (2013.01); *A61H 2201/1261* (2013.01); *A61H 2201/1269* (2013.01); *A61H 2201/1607* (2013.01); *A61H 2201/1638* (2013.01); *A61H 2201/1642* (2013.01); *A61H 2201/1664* (2013.01)

(58) Field of Classification Search

CPC .... A63B 21/00007; A63B 21/00018–21/0025; A63B 21/002–21/0023; A63B 21/154–21/156; A63B 1/00185; A63B 21/151

USPC ..... 482/91, 121–122, 124, 126, 129, 907; 254/391, 403; 602/32–40; 606/241

See application file for complete search history.

(56) References Cited

U.S. PATENT DOCUMENTS

| | | | | |
|---|---|---|---|---|
| 5,067,709 | A | 11/1991 | Christianson | |
| 5,405,306 | A | 4/1995 | Goldsmith et al. | |
| 5,595,559 | A | 1/1997 | Viel | |
| 5,634,873 | A | 6/1997 | Carlstrom | |
| 6,110,083 | A | 8/2000 | Riser | |
| 6,113,564 | A * | 9/2000 | McGuire | 602/32 |
| 6,338,700 | B1 | 1/2002 | Pollock | |
| 7,419,138 | B1 * | 9/2008 | Mauthner | 254/394 |
| 7,867,102 | B2 * | 1/2011 | Wallace | 473/220 |
| 8,192,337 | B2 * | 6/2012 | Birch | A63B 21/00185 482/126 |
| 8,870,723 | B2 * | 10/2014 | Morris | A63B 7/00 472/121 |
| 2002/0187884 | A1 * | 12/2002 | McGrath | 482/121 |
| 2010/0292056 | A1 * | 11/2010 | Birch et al. | 482/129 |
| 2011/0166003 | A1 * | 7/2011 | Brice et al. | 482/131 |
| 2014/0005015 | A1 * | 1/2014 | Hester | A63B 21/154 482/131 |

* cited by examiner

*Primary Examiner* — Oren Ginsberg
*Assistant Examiner* — Jennifer M Deichl
(74) *Attorney, Agent, or Firm* — Daniel Boudwin; Global Intellectual Property Agency, LLC.

(57) ABSTRACT

A body stretching assembly is provided. The assembly comprises a pulley, a plurality of body attachment straps, and a rope. The pulley comprises a securing end and a wheeled end, wherein the securing end includes a frame having a proximal aperture, a protrusion, and a pair of distal legs with fastening apertures. The proximal aperture is configured for connection with a pulley assembly supporting structure, such as a door jam or an exposed support such as a pole. A user threads a rope over the pulley wheel to begin treatment. One end of the rope comprises a hand attachment, whereas the opposing rope end includes one of a head, hand, or ankle attachment. The user pulls one end of the rope, thereby causing the opposing end to pull on the body of a user. Gradual actuation of the rope end provides a stretching exercise to a user.

6 Claims, 7 Drawing Sheets

BODY STRETCHING ASSEMBLY

CROSS REFERENCE TO RELATED APPLICATION

Figure 1:
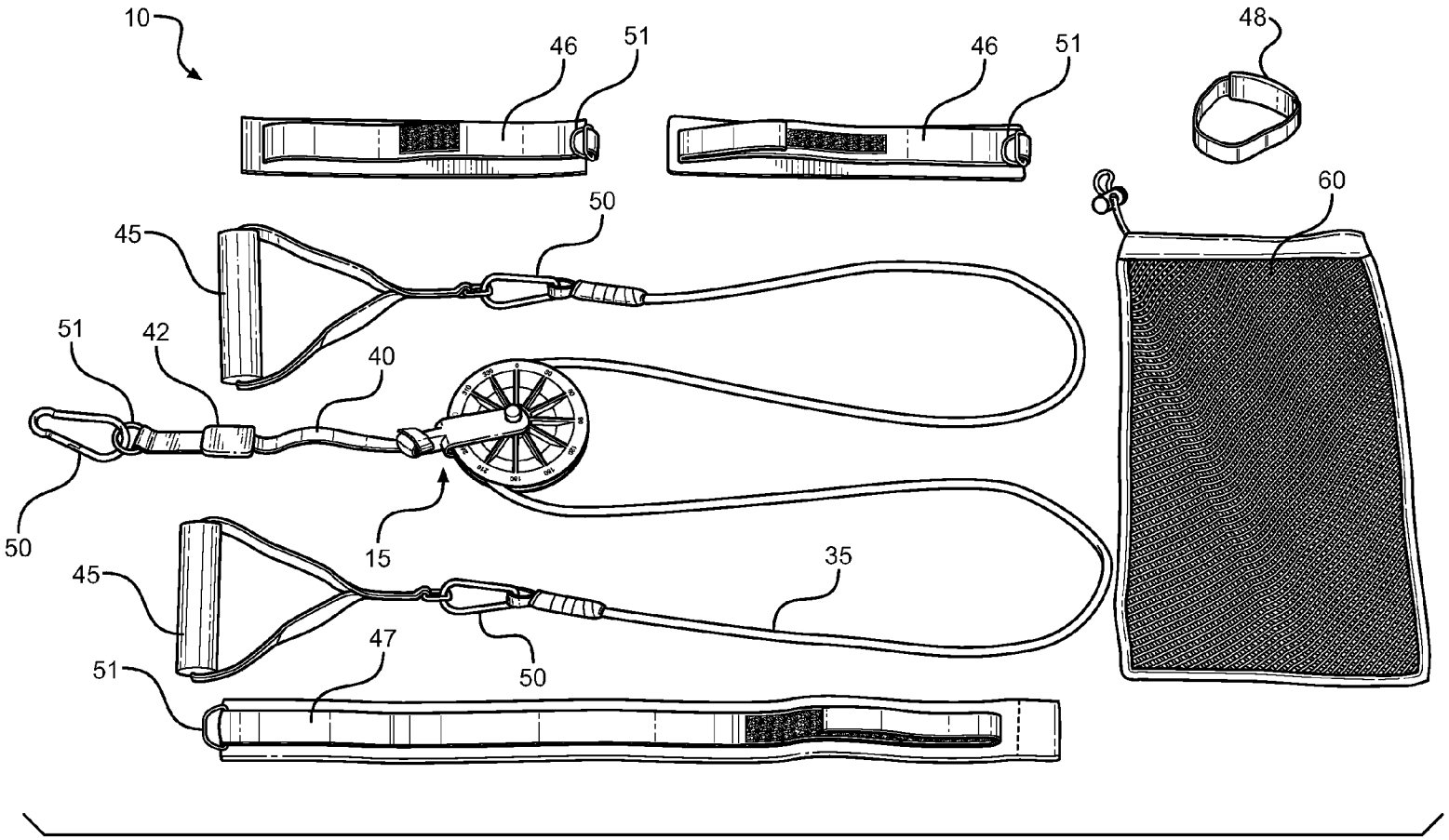

This application claims the benefit of U.S. Provisional Application No. 61/813,074 filed on Apr. 17, 2013, entitled "Body Stretcher". The above identified patent application is herein incorporated by reference in its entirety to provide continuity of disclosure.

BACKGROUND OF THE INVENTION

1. Field of the Invention

The present invention relates to a stretching assembly. More specifically the invention relates to a pulley system that is configured for providing therapeutic stretching and strength exercise to the arms, legs, back, and neck of a user.

Stretching is a type of exercise that is designed to improve the flexibility of a muscle or group of muscles. The result of the exercise is that a user may experience a greater range of motion in their limbs. This increase inflexibility and range of motion is of importance for users who are about to undergo an athletic activity. In addition to increasing the range of motion of muscles, stretching is also shown to prevent injuries, and improve balance, physical performance, and blood circulation.

Many people attempt to stretch but have difficulty doing so without a means to maintain their body parts in positions that facilitate the stretching of their limbs. Incorrect stretching mechanics may lead to effects that are opposite of what is desired. Poor technique may potentially lead to permanent damage to the tendons, ligaments, and muscle fibers of the body. Therefore, there is a need for devices that are configured to assist a user with facilitating proper stretching techniques.

There are several prior art devices that are designed to facilitate proper stretching techniques. These devices often comprise pulley systems that include an actuatable pulley rope. During use, a user may pull on one rope end, which causes a pulling force on the opposing rope end. The opposing end may comprise attachment mechanisms connected to the legs of a user, thereby providing a therapeutic stretching treatment to a user.

The present invention, however, provides a pulley system that is configured for providing a stretching exercise to the body. The pulley system comprises a pulley, having a pulley frame and a pulley wheel, a pulley rope, a pulley support strap, and a plurality of body attachments, including that of hand, ankle, and head. The pulley system of the present invention further provides a pulley comprises a pulley frame and pulley wheel that have corresponding U-shaped channels that are configured to retain a pulley rope therein when utilized at a plurality of differing angles, thereby facilitating a continuous and undisturbed stretching exercise for a user.

2. Description of the Prior Art

Devices have been disclosed in the prior art that relate to exercise pulley systems. These include devices that have been patented and published in patent application publications. These devices generally relate to large and static systems that are utilized to administer stretching of a user's muscles. The following is a list of devices deemed most relevant to the present disclosure, which are herein described for the purposes of highlighting and differentiating the unique aspects of the present invention, and further highlighting the drawbacks existing in the prior art.

One such prior art device, U.S. Pat. No. 6,110,083 to Riser provides a transportable stretching system that that comprises a base having a mechanism for restraining one of the user's legs. A pulley system connected to the base comprises one end configured for manual actuation, whereas the opposite end is configured for attachment to a user's ankle. Actuation of the first end results in a pulling of the user's leg, thereby facilitating the stretching of the user's leg. After use the device may be folded up and transported. The device, however, lacks the compactness of the present invention, fails to provide an attachment for securement within a doorway, and further fails to provide an attachment for stretching the muscles of the neck.

Another prior art device, U.S. Pat. No. 6,338,700 to Pollock provides an adjustable leg stretcher that is used to facilitating stretching of a user's hamstrings when the user is lying in a supine position. The stretcher comprises a pulley and a pulley rope with ends that are securable onto a user. Actuation on an end comprising hand grips results in the movement of an opposing end that is connected to the ankle of a user. The system may be secured between a door jamb and a door or other support such as a fence post. While similar in nature and relevant to the present invention, the prior art differs in that it fails to provide a pulley frame and pulley wheel with corresponding U-shaped channels that prevent the accidental removal of the pulley rope during use.

Yet another prior art device, U.S. Pat. No. 5,634,873 to Carlstrom provides a hamstring stretching device that is securable onto the underside of a door by a clamp. The device comprises a rope that is threaded through a pulley system to impart a stretching exercise to the user. One end of the pulley rope comprises a user actuatable handle, whereas the opposing end comprises a foot attachment means. The device of Carlstrom, however, differs from the present invention in that it fails to provide connecting means for a variety of support structures, and further fails to provide a neck stretching means.

U.S. Pat. No. 5,067,709 to Christianson provides an unassisted lower torso stretching device that stretches and strengthens the muscles of the lower back and legs of a user. The device comprises a pulley system having a pulley and a rope with a user actuation means. The device further includes a board with straps that are configured to retain the pelvis of a user, thereby maintaining the torso a user in position while the stretching exercise is performed. Actuation of one end of the rope causes the opposing end to raise the leg of the user, thereby stretching the leg. The pulley system, however, is configured for fastening into a wall, whereas the present invention is configured for non-permanent attachments, thereby increasing the portability of the device.

Yet another prior art device, U.S. Pat. No. 5,405,306 to Goldsmith provides a device configured for stretching tendons, muscles, and associated soft tissues of human joints. The device comprises a pulley that is secured onto an upright support. A pulley cord is threaded onto the pulley. One end of the pulley cord is configured for actuation of a user, while an opposing end is secured to the leg of a user. By pulling on the cord the pulley system performs a stretching exercise on the leg of the user. Different orientations of the legs may impart differing forms of stretching on the legs of the user. Although the prior art of Goldsmith is similar in nature and relevant to the present invention, it differs in that it fails to provide an easily portable device that may be connected to differing support devices.

Finally, U.S. Pat. No. 5,595,559 to Viel provides a stretching apparatus that is configured for stretching the leg of a user. The device comprises a doorknob attachment, a locking device, a rope, and a foot attaching means. The locking device is connected to a rope that is attachable onto a doorknob at one end and is configured to retain a second rope on the opposing end. The second rope may have a hand actuation end and a foot attachment end. Actuation of the rope causes a pulling force on the foot attachment end, thereby providing a stretching exercise to the food of a user. Although the prior art device is useful for its own purposes, it fails to anticipate the present invention by failing to provide a pulley system having a wheel that is configured for retaining a pulley rope.

The present invention provides an easily transportable body stretching assembly. The assembly comprises a pulley, a multitude of body attachments, a pulley support strap, and a pulley rope. The pulley comprises two sections. A first section comprises a pulley frame that has a pulley support strap aperture and an opposing end comprises a U-shaped protruding channel and bifurcating legs. The second section comprises a pulley wheel that comprises a U-shaped channel that corresponds to the channel of the pulley frame. The legs of the frame are configured to provide an attaching means between the pulley wheel and the pulley frame. The pulley strap may be secured between a doorframe and a closed door, or to an outside structure, such as a pole, fence post or other stable object. The pulley rope is configured to be threaded between the corresponding channels of the pulley frame and the pulley wheel. The channels prevent the pulley rope from separating from the pulley when utilized at different angles. The ends of the pulley rope may each comprise body attachment means. One end may comprise a hand gripping attachment, whereas the opposing end may comprise head, hand, or ankle attachments. Actuation of the hand grip end causes a pulling force on the opposing end, thereby pulling at the head of the user. Gradual actuation by the user facilitates the stretching of the neck muscles of the user. The user may orient their body in different positions in order to stretch or strengthen the different muscles of the neck, legs, back, or arms. The pulley wheel comprises indicia thereon, that is adapted for informing a user as to their degree of stretching, thereby providing a reference point for future progress.

It is submitted that the present invention is substantially divergent in design elements from the prior art and consequently it is clear that there is a need in the art for an improvement pulley exercise devices. In this regard the instant invention substantially fulfills these needs.

SUMMARY OF THE INVENTION

In view of the foregoing disadvantages inherent in the known types of stretching devices now present in the prior art, the present invention provides a new body stretching assembly wherein the same can be utilized for providing convenience for the user when portability and the option of exercising the muscles of the neck are desired.

It is therefore an object of the present invention to provide a new and improved body stretcher that has all of the advantages of the prior art and none of the disadvantages.

It is another object of the present invention to provide a stretching device that comprises a neck strengthening and stretching means.

Another object of the present invention is to provide a pulley support strap comprises a protrusion that is configured for securement between a door frame and a door.

Yet another object of the present invention is to provide a pulley having corresponding U-shaped channels that are configured for retaining a pulley rope therein.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 1 displays the body stretching assembly of the present invention.

Figure 2:
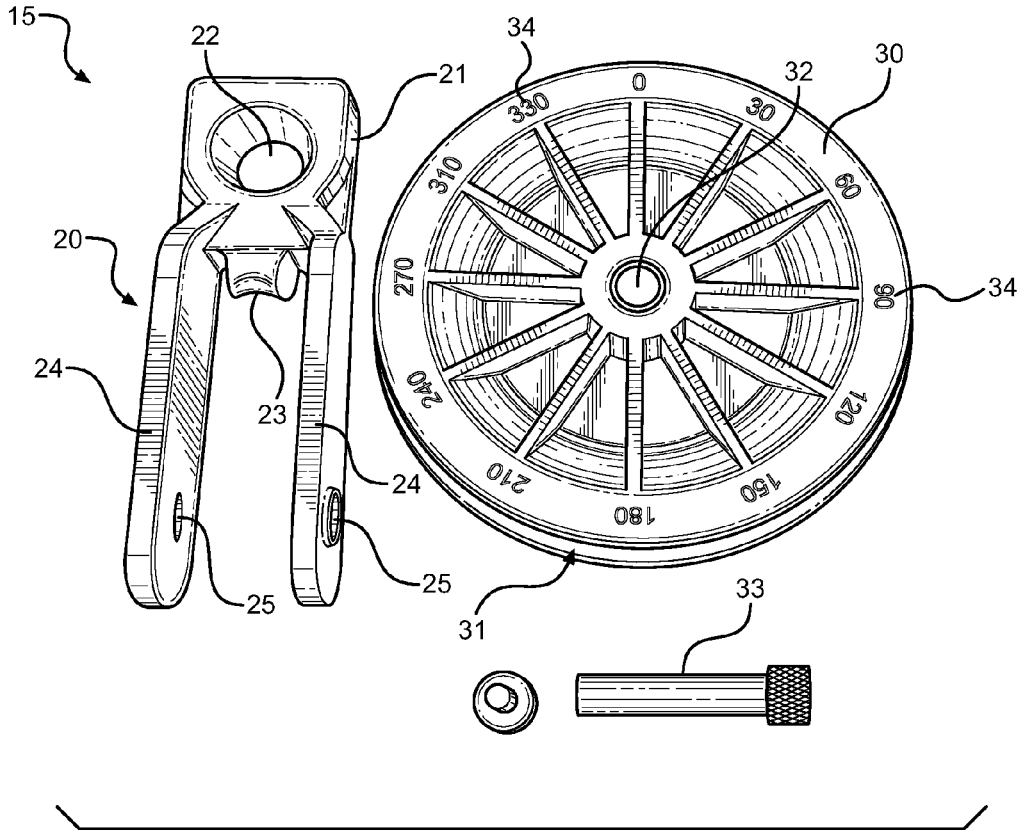

FIG. 2 displays a view of the pulley frame and pulley wheel.

Figure 3:
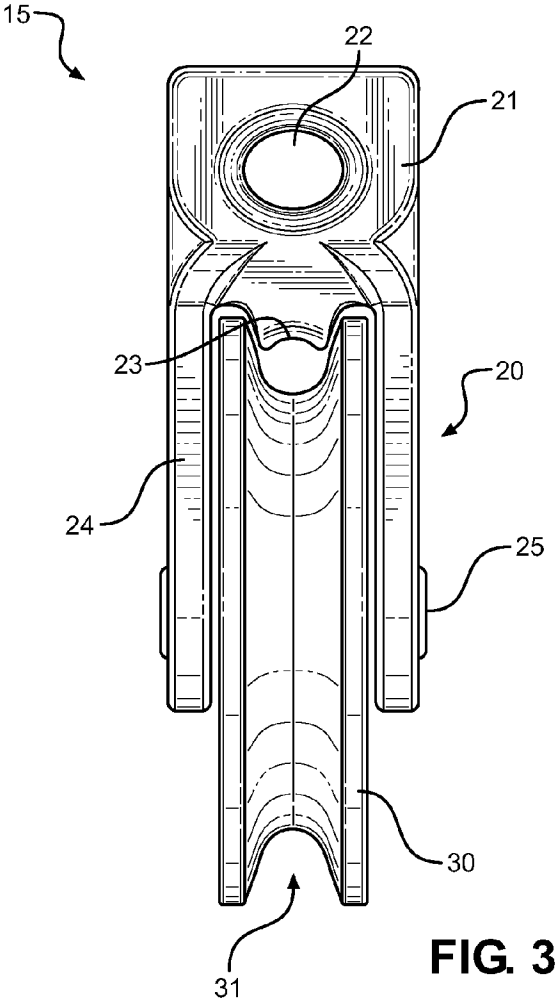

FIG. 3 displays a straightforward view of the pulley.

Figure 4:
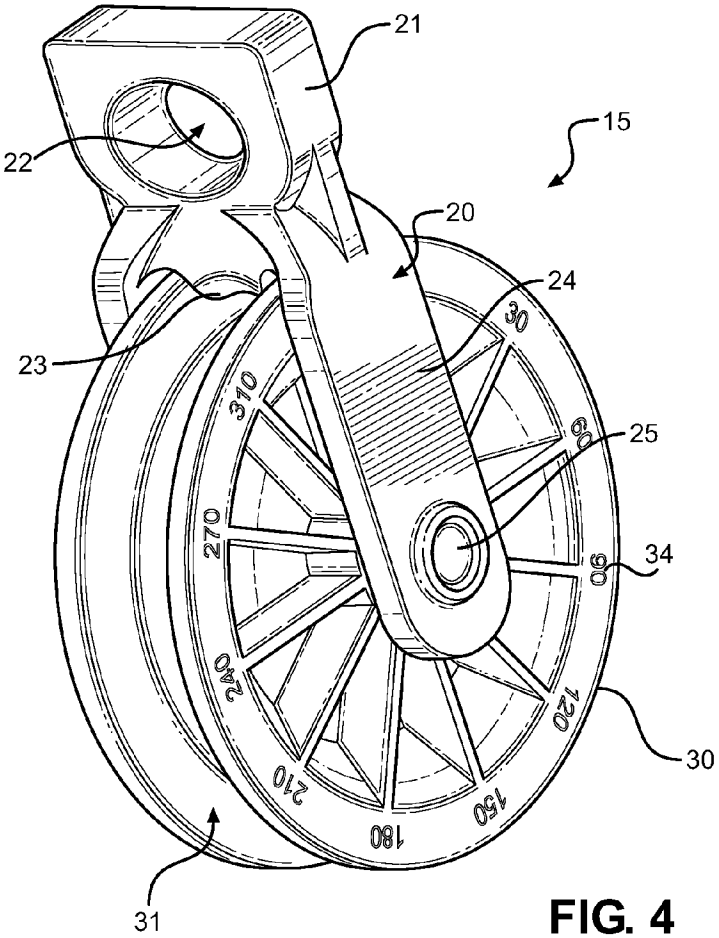

FIG. 4 displays a perspective view of the pulley.

Figure 5:
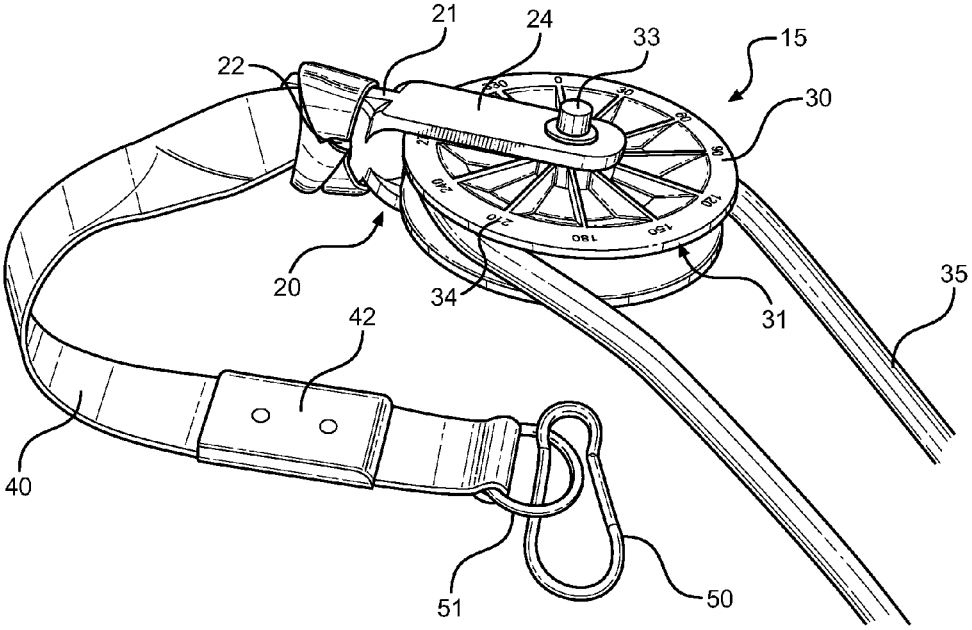

FIG. 5 displays a perspective view of the pulley and support strap of the present invention.

Figure 6:
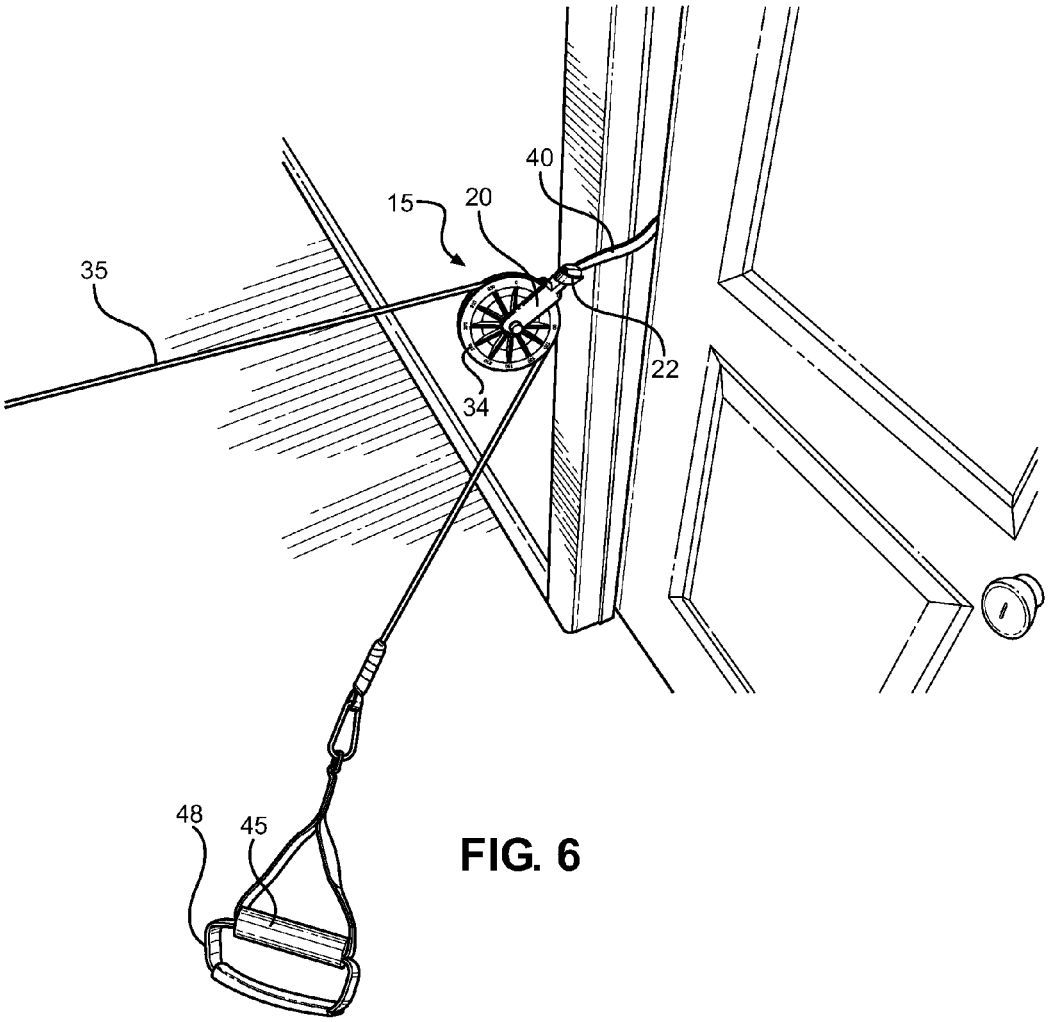

FIG. 6 displays a view of the body stretching assembly supported within a door jam.

Figure 7A:
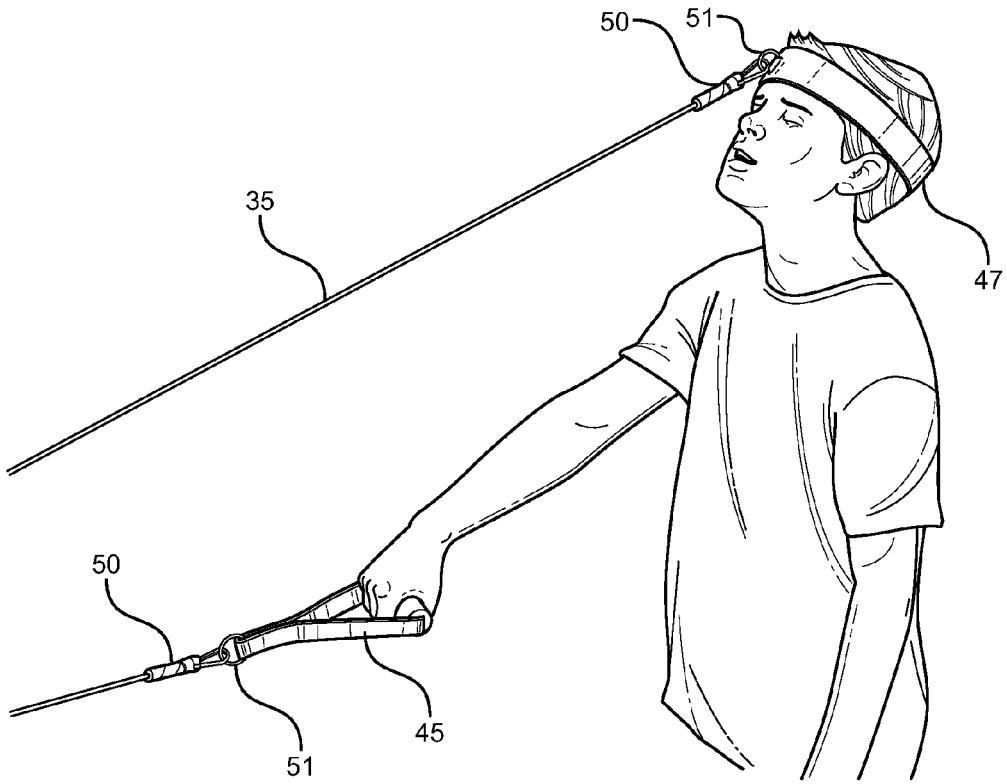
Figure 7B:
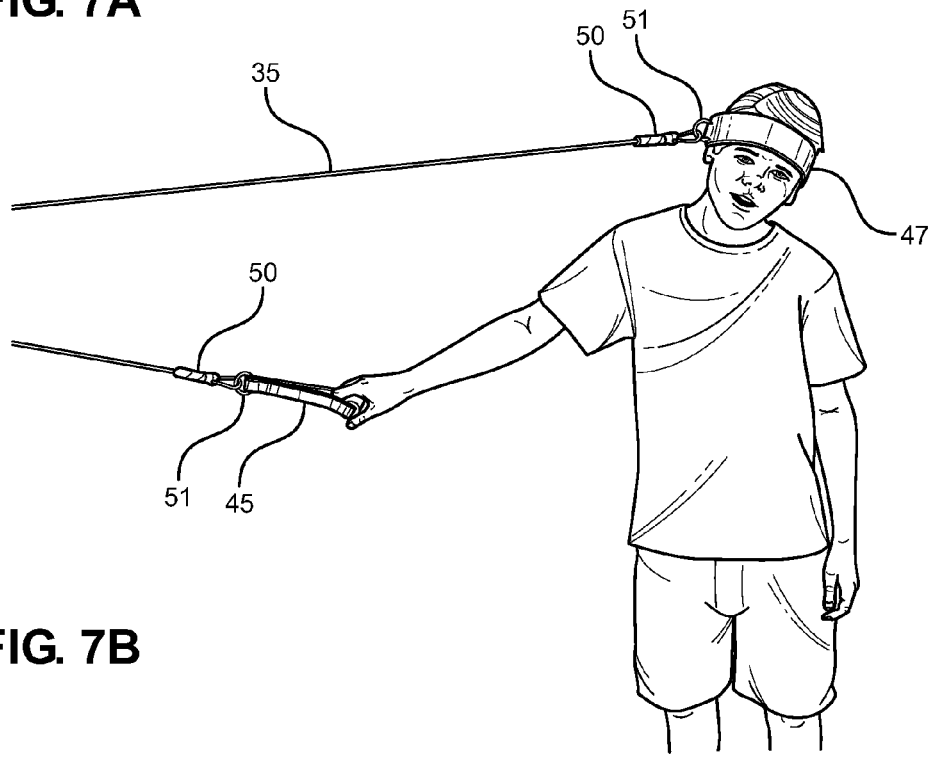

FIGS. 7A and 7B display views of the stretching assembly in use, whereby the assembly is used for stretching the neck of a user.

Figure 8:
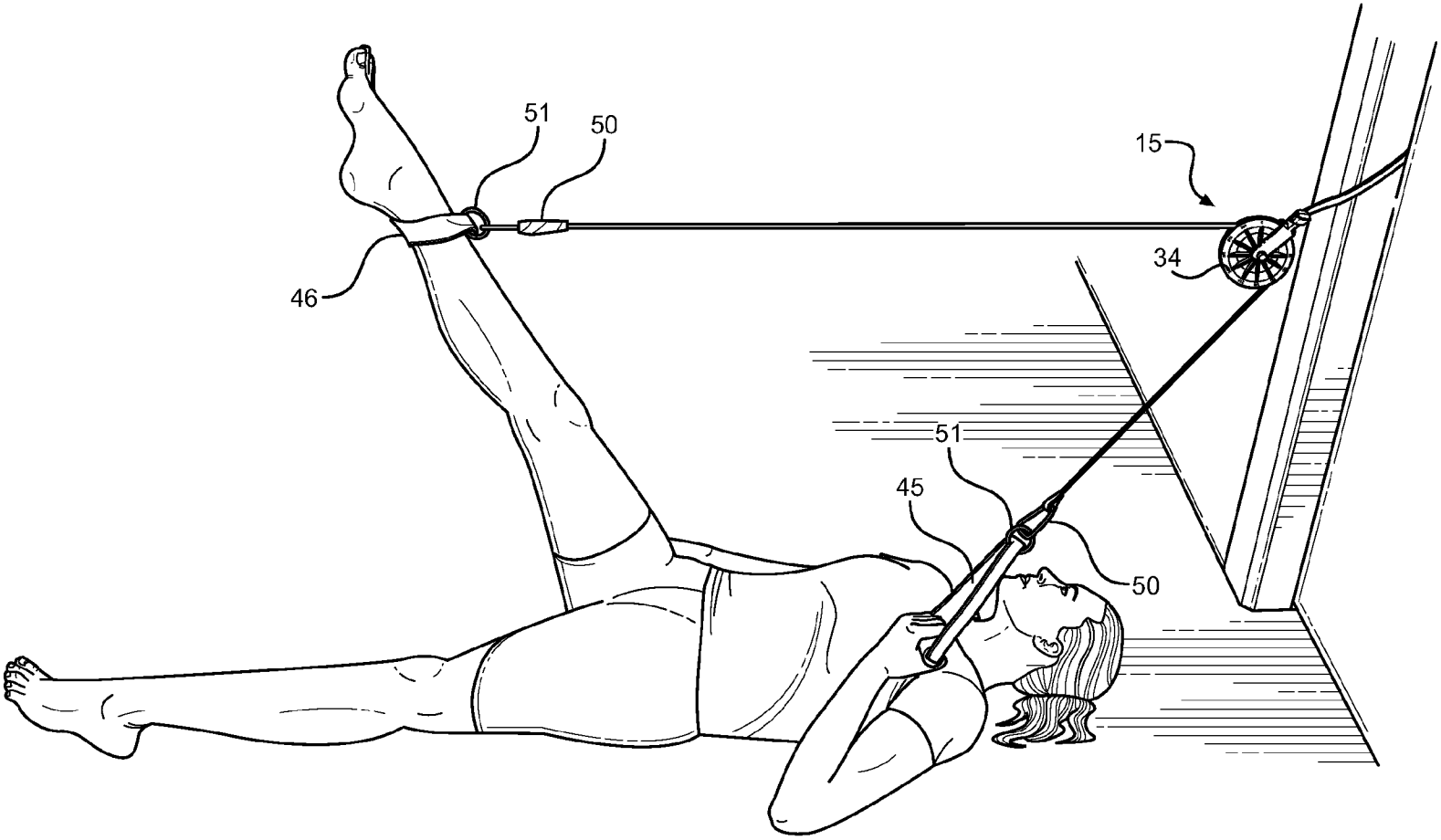

FIG. 8 displays a view of the stretching assembly in use, whereby the assembly is used for stretching the leg of a user.

DETAILED DESCRIPTION OF THE INVENTION

Reference is made herein to the attached drawings. Like reference numerals are used throughout the drawings to depict like or similar elements of the body stretching assembly. For the purposes of presenting a brief and clear description of the present invention, the preferred embodiment will be discussed as used for providing a stretching therapy to the arms, legs, or neck of a user. The figures are intended for representative purposes only and should not be considered to be limiting in any respect.

Referring now to FIG. 1, there is shown a view of the body stretching assembly of the present invention. The assembly 10 comprises a pulley 15, a plurality of body attachment straps 45, 46, 47, 48, a support strap 40, a pulley rope 35, and a transportation bag 60 that is adapted for holding the assembly therein. A user may pull on an end of the body stretching assembly to facilitate the stretching of the body of the user.

A pulley rope 35 can be threaded over the pulley 15 to begin treatment. One end of the rope 35 may comprise a hand attachment 45, whereas the opposing rope end may comprise a body limb attachment 46, 47. The user then pulls on one end of the rope, thereby causing the opposing end to pull on the body of a user. Gradual actuation of the hand attachment 45 provides a stretching exercise to a user. The body attachments comprise hand attachments 45, a neck exercising strap 47 adapted for retaining around the forehead of a user, and ankle attachments 46. Each of the body attachments include O-rings 51 that enable attachment to a clip 50 that facilitates a connection between the pulley rope 35 and the body attachment straps. The assembly 10 further includes a stirrup attachment 48 that is adapted to be threaded through the hollow interior of the handle 45. The stirrup attachment 48 provides a different gripping means, or may be secured around the arms or wrists of a user. A user is capable of using the assembly to facilitate the stretching of the muscles of a user's neck, arms, back, and legs, thereby performing a therapeutic exercise on the body.

FIG. 2 displays a separated view of the pulley 15, whereby the pulley comprises two separate parts. The first section is configured for securing onto a supporting member and the second section is configured to provide rotation of the rope within the pulley. The first section includes a pulley frame 20 having a proximal end 21 with a proximal aperture 22, a protrusion 23, and a pair of distal legs 24 with fastening apertures 25. The proximal aperture 22 is configured for connection with a pulley assembly supporting structure, such as a door jam or an outside object such as a pole. For example, a pulley supporting strap (40, See FIG. 1) may be secured through the proximal aperture 22. Thereafter the strap may be secured onto a variety of different supporting structures.

The second section includes a pulley wheel 30 that is configured for insertion within the distal legs 24 of the first section frame 20. The wheel 30 may be rotatably fastened to the distal legs 24 of the first section frame 20 by threading a fastener 33 through the aperture of the wheel 32 and apertures 25 of the distal legs 24. The perimeter of the wheel comprises indicia 34. The indicia 34 comprise rotational degree markers (numbers) that are representative of the degrees of a circle. A user may visually inspect an initial starting point of stretching prior to beginning the exercise. Thereafter, a user can identify their stretching progress by comparing a starting point with indicia 34 that correlates with the endpoint of their stretch. This enables a user to quickly identify their stretching progress and can further serve as motivation for continued use of the pulley assembly.

Referring now to FIGS. 3 and 4, there are displayed straightforward and perspective views of the pulley of the present invention, whereby FIG. 3 displays a straightforward view and FIG. 4 displays the perspective view. A pulley rope (35, See FIG. 1) is threaded through the opening between the protrusion 23 of the frame of the first section 20 and the U-shaped channel 31 of the pulley wheel 30. The protrusion 23 of pulley frame 20 and the opposing U-shaped channel 31 formed by the pulley wheel 30 are configured to provide a closure around a pulley rope. The U-shaped channels of the protrusion 23 and pulley wheel channel 31 further act to maintain a pulley rope therein when the assembly is used at a variety of different angles. In use, a user may utilize a swinging or rotating motion when stretching with the assembly. The U-shaped channels are configured to retain the rope therein while also enabling the rope to translate between the first 20 and second pulley sections 30, thereby enabling continuous use of the assembly during differing exercises. A user may then reference the indicia 34 on the perimeter of the wheel 30 to keep track of progress when stretching at different angles.

The pulley wheel 30 is a circular structure having indicia 34 thereon such that the assembly can function as a goniometer during stretching activities. The user draws the pulley rope around the pulley wheel, using the indicia 34 as a means to measure the exact angular displacement the pulley wheel makes during the stretching action. The angular rotation translates into a given arc length, which in turn is a measure of the stretching distance for the user's limb receiving the tension of the pulley rope. The stretching activity is thus a passive resistance exercise, or self-controlled exercise that slowly stretches the given body part of the user. The amount of tension and the degree of rotation is dictated by the user, wherein the stretching itself is low impact and relatively static. The pulley rope itself is a bungee cord or sports cord, while the pulley wheel is supported along a wheel axle that passes through a central aperture 25 in the wheel. The pulley wheel is supported on the axle by way of a greaseless bearing to facilitate smooth rotation and minimal resistance during the stretching activity.

FIG. 5 displays a perspective view of the pulley and pulley rope of the present invention. The assembly includes a pulley 15, a pulley rope 35, and a pulley securement strap 40. The pulley includes a first and second section, whereby the first section comprises a frame 20 for supporting a pulley wheel 30, and the second section comprises a pulley wheel 30 configured for rotating about the frame 20. A pulley support strap 40 can be secured onto the proximal aperture 22 of the proximal end 21 of the frame of the first pulley section 20. The pulley support strap 40 comprises a raised mid-section 42 and a distal O-ring. The raised mid-section 42 is configured for facilitating a securement between a closed door and a door frame, whereas the distal O-ring 51 is configured for facilitating the connection between an attachment clip 50 and the body stretching assembly.

FIG. 6 displays a view of the body stretching assembly secured within a doorway. The first section 20 of the pulley 15 comprises a proximal aperture 22 that is configured for the reception of a pulley support strap 40. The support strap 40 may be flat and elongated, thereby enabling the device to be placed between a doorframe and a closed door. A raised portion (42, See FIG. 5) along the length of the strap prevents the strap from being removed from the doorway when the door is closed. The prevention of the removal of the support strap 40 enables a user to perform a stretching exercise without worry of the assembly detaching from the doorway. Additionally, the distal end of the support strap may include an O-ring (51, See FIG. 5) configured for receiving an attachment clip (50, See FIG. 5), thereby enabling the attachment of the support strap on other support frames.

FIG. 6 further displays the attachment between the handle 45 and the stirrup attachment 48, whereby the attachment 48 is threaded through the hollow interior of the handle 45. An individual may grip the stirrup 48 and exercise in a traditional manner, or secure the stirrup 48 on to the body. The stirrup 48 provides a more flexible attachment that is adapted to better conform to the body of the user, thereby providing enhanced stretching by enabling slight angular changes that facilitate the stretching of different muscle groups.

Referring now to FIGS. 7A and 7B, there are displayed views of the stretching assembly in use, whereby the assembly is used for stretching the neck of a user. In use, a user may secure the pulley support strap within a doorway or around a suitable support structure. One end of the pulley rope 35 may comprise a hand attachment 45 that is configured for facilitating the exercise. The opposing rope end may comprise a body attachment, whereby the attachment may be a hand grip, a headband strap, and an ankle strap.

The head band 47 is configured for providing a therapeutic stretching exercise to the neck of a user. The head band 47 comprises an elongated strap with a fastening means 50 and an O-ring attachment 51. A hand grip 45 may be attached to one end of the pulley rope 35, and the head band 47 may be attached to an opposing end of the rope 35. Thereafter, the pulley support strap (40, See FIG. 5) may be secured around a support frame. A user can wrap the head band 47 around their head and then secure the headband strap with a fastener, whereby the fastener may be a hook and loop fastener, snaps, or other suitable fastening means.

The head of the user may face the pulley straightforward as shown in FIG. 7A, perpendicular to the pulley as shown in FIG. 7B, or in similar orientations that facilitate exercising the neck of a user. Actuation of the hand grip 45 results in a pulling force on the head band 47 on the opposing side of the pulley rope 35. A user may strengthen the muscles of the neck by moving the head in a direction opposite to that of the directional forces applied by the pulley rope. The resistive head movements may be provided at a variety of angles in order to work out each of the muscles of the neck. The pulley rope may also facilitate the stretching of the neck muscles by providing a pulling force that stretches the ligaments and muscles of the neck when the head band is secured around the head of a user.

Referring now to FIG. 8, there is shown a view of the stretching assembly in use. An actuating end of the pulley rope can comprise a hand grip 45, whereas the opposing end comprises an ankle strap 46. To perform a leg stretching exercise, a user may lie down with their legs pointed in an opposing direction from a supporting frame. The user may pull on the hand grip 45, thereby causing the leg of a user to move towards the pulley 15. The positioning of the user determines the direction that the leg is pulled, and the muscles that are stretched. A user may position their legs in different angles in relation to the pulley in order to provide a complete leg stretching exercise. The user can reference the indicia 34 on the pulley wheel to determine the progress of their stretching in relation to past exercises, thereby providing motivation for continued stretching, or indicating when a user has achieved their flexibility goals.

The present invention provides a pulley-actuated body stretching assembly. The assembly 10 comprises a pulley 15, a plurality of body attachment straps 45, 46, 47, 48, and a pulley rope 35. The pulley 15 comprises two sections. The first section includes a frame 20 that comprises a securing end. The securing end includes a pulley frame proximal end 21 having a proximal aperture 22, a protrusion 23, and a pair of distal legs 24 with fastening apertures 25. The aperture 22 is designed to receive a strap 40 that is adapted for attaching the pulley assembly onto a supporting structure, such as a door jam or an outside object such as a pole. The distal legs 24 of the pulley frame are bifurcated and are configured for receiving the wheeled end 30 of the pulley.

A pulley rope 35 may be inserted between the pulley wheel 30 and the proximal end 21 of the pulley frame 20. The U-shaped channel of the protrusion 23 of the pulley securing end and the U-shaped channel 31 of the pulley wheel 30 are configured to receive the pulley rope 35 and maintain the rope therebetween during differing angular orientations of the pulley wheel, thereby enabling use of the device in a variety of exercises. One end of the pulley rope 35 may comprise a hand grip 45 attachment for actuation of the opposing end of the rope. The opposing rope end may comprise a head 47, hand 45, ankle 46, and stirrup attachment 48. The user then pulls on one end of the rope, thereby causing the opposing end to pull on the body of a user. Gradual actuation of the rope end provides a stretching or strengthening exercise to the neck, arms, back or legs of a user. A user can reference indicia 34 that are provided on the perimeter of the pulley wheel 30, thereby providing the user with information about the progress of their stretching.

Exercise plays an important role in maintaining a healthy body. Regular exercise can reduce risk for heart disease, strokes, osteoporosis and diabetes, and it can also help an individual lose weight. Many exercise devices, however, only target certain areas of the body or are too intense and overly impactful for those with reduced capacity (the injured, handicapped, or the elderly). The present invention is intended as a passive resistance exercise that is self-controlled, whereby the degree of stretching and the tension on the user's body is dictated by the user. The device is submitted as being useful for obtaining a greater range of motion throughout stretching, facilitating rehabilitation and limberness for athletes, the elderly, and the impaired alike. The assembly functions as a goniometer and self-controlled stretching assembly that is readily deployed by users of all types.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A body stretching assembly, comprising;

a pulley having a first section and a second section;

said first section comprising a frame having a proximal aperture, a protrusion, and a pair of distal legs having fastening apertures;

wherein said pulley support strap comprises: a first end configured for connection to said proximal aperture of said first section, a second end having an O-ring thereon, and a raised portion on a central portion, said raised portion adapted to allow said pulley support strap to be secured between a closed door and a door frame, wherein said central portion is located between said first end and said second end;

whereby said first section is configured for placement over said second section, said second section comprising a wheel being rotatably fastened to said pair of distal legs;

whereby said wheel comprises a channel along a perimeter of said wheel;

whereby said protrusion is positioned over said channel on said wheel when said first and second sections are secured together;

said wheel of said second section is operably connected to a pulley rope, whereby said pulley rope is adapted to be retained between said channel and said protrusion;

wherein said protrusion extends into said channel of said wheel, and wherein said protrusion comprises a concave configuration such that the protrusion restrains said pulley rope within said channel;

wherein said pulley rope comprises a proximal hand grip end and a distal body attachment end;

a hand grip for attachment to said proximal hand grip end of said pulley rope;

a body attachment strap comprising an elongated strap having an O-ring thereon for attachment to said distal body attachment end of said pulley rope, and wherein said body attachment strap is adapted to be wrapped around a limb or head of a user and secured thereon by means of hook and loop fastening material disposed on said elongated strap.

2. The body stretching assembly of claim 1, wherein said proximal hand grip end comprises a stirrup attachment extending from said hand grip.

3. The body stretching assembly of claim 1, wherein said proximal hand grip end comprises a fastener thereon for securing said hand grip thereon, and wherein said distal body attachment end comprises a fastener for securing said body attachment strap.

4. The body stretching assembly of claim 1, wherein said wheel comprises one or more ribs on an exterior surface thereof.

5. A body stretching assembly, comprising:

a pulley having a first section and a second section;

said second section comprising a wheel rotatably mounted to said first section;

a pulley support strap affixed at a first end to said first section, and having a fastener on a second end thereof, wherein a raised portion is positioned on said pulley support strap between said first end and said second end, said raised portion adapted to allow said pulley support strap to be secured between a closed door and a door frame;

a channel disposed on said wheel in which a pulley rope is movably positioned;

a protrusion extending from said first section into said channel of said wheel, wherein said protrusion comprises a concave configuration adapted to restrain said pulley rope within said channel;

said pulley rope having a first end and a second end, wherein said first end comprises a hand grip, and wherein said second end includes a body attachment strap adapted to be removably secured to a portion of a user's body.

6. The body stretching assembly of claim 5, wherein the first section and second section of the pulley are removably secured together, and wherein the pulley rope is removably positioned on the wheel of the second section.

* * * * *